United States Patent [19]

Olson

[11] Patent Number: 4,998,310

[45] Date of Patent: Mar. 12, 1991

[54] BREAKDOWN AIR MATTRESS ASSEMBLY

[76] Inventor: Robert V. Olson, 104 Shaw St., Greenville, S.C. 29609

[21] Appl. No.: 543,208

[22] Filed: Jun. 25, 1990

Related U.S. Application Data

[63] Continuation of Ser. No. 257,713, Oct. 12, 1988, abandoned.

[51] Int. Cl.[5] ..... A47C 19/00

[52] U.S. Cl. ..... 5/449; 5/474; 5/201

[58] Field of Search ..... 108/56.1; 273/157 R, 273/156; 403/3, 4, 361, 364, 381, 404; 5/401, 474, 470, 465, 453, 452, 449, 499, 201, 200 C, 285, 282 R, 400, 481, 450, 451

[56] References Cited

U.S. PATENT DOCUMENTS

| | | | |
|---|---|---|---|
| 3,157,889 | 11/1964 | Chanko | 5/465 |
| 3,249,953 | 5/1966 | Leskin et al. | 5/285 |
| 3,736,605 | 6/1973 | Klein, Jr. | 5/401 |
| 4,193,151 | 5/1980 | Calleange | 5/452 |
| 4,306,322 | 12/1981 | Young et al. | 5/449 |
| 4,394,784 | 7/1983 | Swenson et al. | 5/453 |
| 4,402,097 | 9/1983 | Scott | 5/400 |
| 4,491,993 | 1/1985 | Santo | 5/452 |
| 4,532,217 | 10/1982 | O'Rourke | 5/451 |
| 4,629,431 | 12/1986 | Sanders | 273/157 R |
| 4,644,597 | 2/1987 | Walker | 5/453 |
| 4,651,368 | 3/1987 | Santo | 5/452 |
| 4,734,746 | 5/1988 | Saputo | 5/400 |
| 4,774,733 | 10/1988 | Akers | 5/400 |

FOREIGN PATENT DOCUMENTS

| | | | |
|---|---|---|---|
| 1270 | of 1861 | United Kingdom | 5/200 R |
| 5919 | of 1900 | United Kingdom | 5/285 |
| 22102 | of 1915 | United Kingdom | 5/201 |

*Primary Examiner*—Eric K. Nicholson

[57] ABSTRACT

A breakdown air mattress assembly (A) is illustrated which includes a mattress (B) enclosed within a foam perimeter deck (C) which are both enclosed within a mattress cover (10). Deck (C) comprises individual deck sections (40*a*, 40*b*) which comprise a first side wall (32). Second deck sections (42*a*, 42*b*) which comprise a second side wall (34). Front deck sections (44*a*, 44*b*) comprising a front wall (36); and back deck sections (46*a*, 46*b*) comprising a back wall (38). Dissimilar joint means (D, E, F) join together the respective deck sections so that assembly may be had only in a prescribed and correct manner. A web (90) joins front and back sections (36, 38) together to cover a longitudinal joint (22) formed between dual mattresses (12, 14) in the case of a queen size or king size bed arrangement.

16 Claims, 2 Drawing Sheets

Fig. 1.
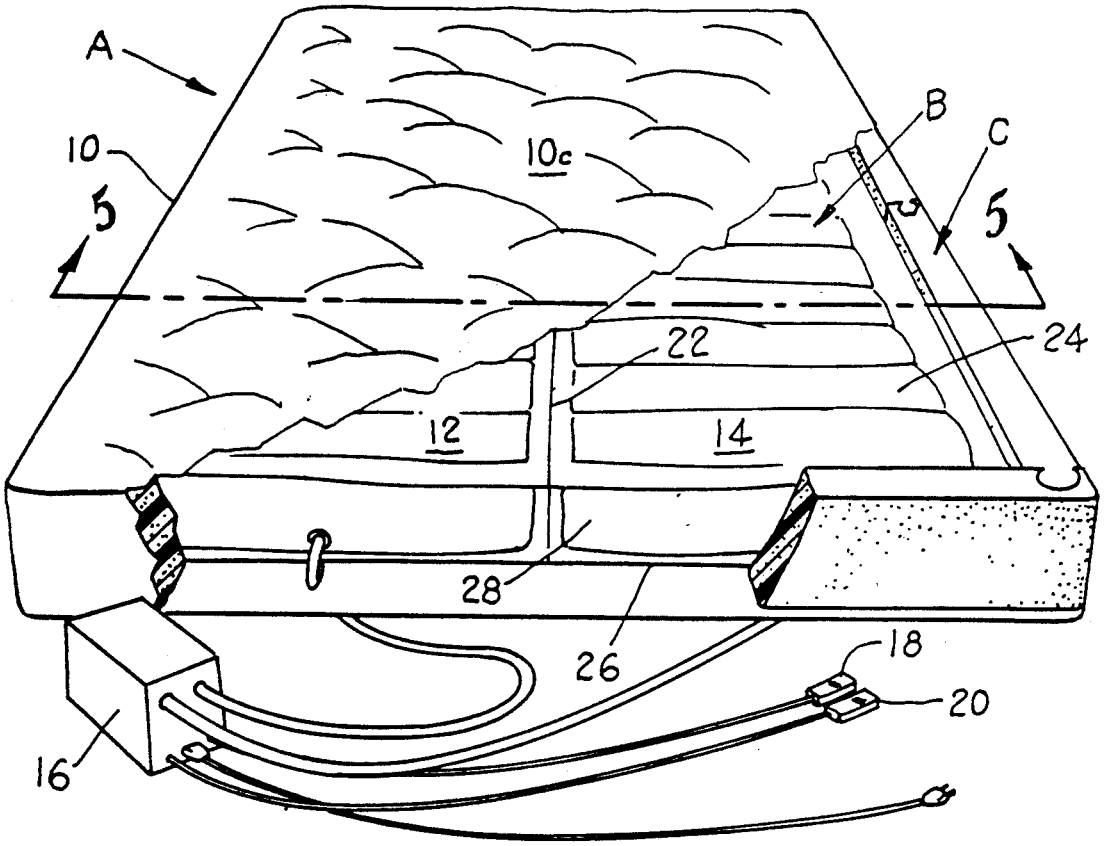
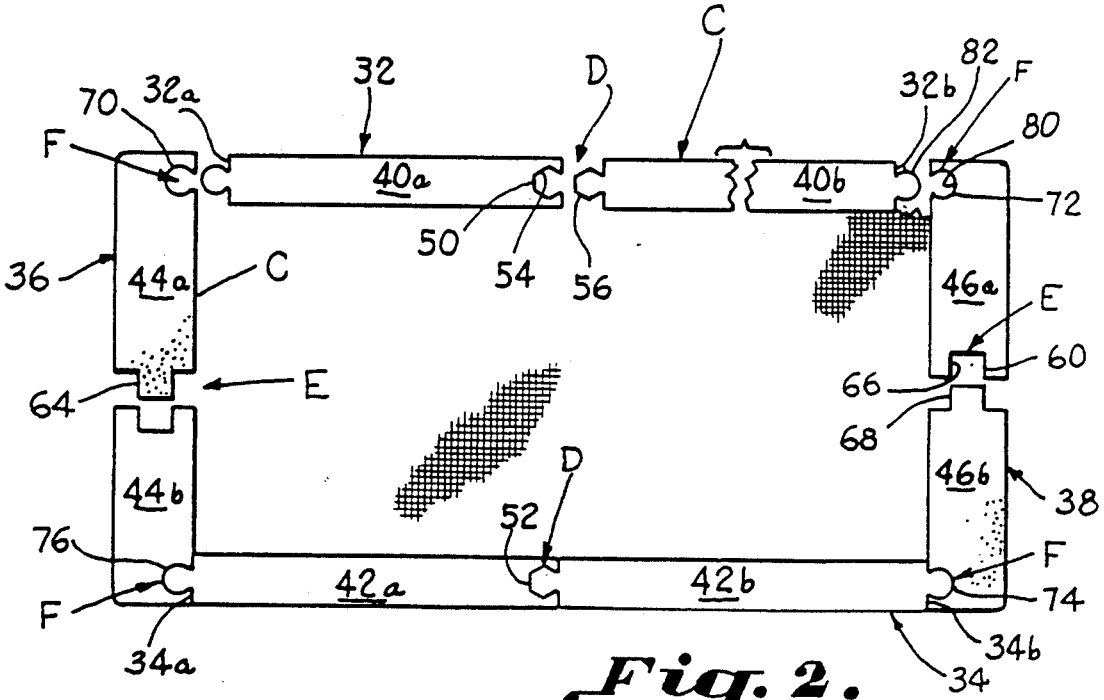
Fig. 2.

BREAKDOWN AIR MATTRESS ASSEMBLY

This application is a continuation of Ser. No. 257,713, now abandoned.

BACKGROUND OF THE INVENTION

The invention relates to the field of mattresses and more particularly to an air mattress. Air mattresses which may be adjusted in their firmness have become increasingly popular over the years for use as conventional bedding. In particular, the air mattresses are popular because they may be easily broken down for shipment and for storage. The typical air mattress kit includes an inflatable air mattress, which may be either a single or a dual unit, a resilient foam deck which surrounds the air mattress and a zipper cover in which the air mattresses and perimetal foam deck are inserted, and an air pump and automatic controls.

Typically, the foam deck is made in a plurality of individual sections for shipment or storage when the air mattress is deflated. It has been known to cut the deck into sections by forming angular cuts across the foam block which creates planar mating faces. The planar faces may be secured by tape or adhesive. The deflated air mattress, broken apart deck sections, and folded cover, may be easily placed in a package small enough for shipment in parcel post or for convenient storage in a closet or attic. A stored air mattress may be reassembled as needed for an air mattress for overnight guests or for reuse when an additional bedroom is added. When moving from one residence to another, considerable savings is had by moving the mattress in a broken down condition. However, the problem occurs that the prior foam deck sections, which comprise the perimetal deck around the air mattress, are typically assembled by using various methods such as double faced tape, adhesive, or no attachment at all. When initially assembling the mattress, if the deck sections are incorrectly positioned in the air mattress cover, they have to be torn apart in order to reposition them correctly. Likewise, when it is desired to break the mattress down into component parts, the adhered two ends of the foam decking become torn and tattered. In either case, damaged foam sections result which often need replacing. Due to the nature and shape of the deck sections, replacement is often difficult if it cannot conveniently be had from the factory. If the ends of the deck sections are left unjoined, the ends of the deck sections may individually protrude in the mattress cover which is both an unattractive sight and uncomfortable condition. U.S. Pat. No. 4,394,784 illustrates conventional foam blocks used for assembling a deck about an air mattress in an air mattress assembly. U.S. Pat. No. 4,734,946 discloses a knock down foundation for a water bed and the like.

It has also been known to use a plurality of narrow bands to connect opposing deck sections across a width of an air mattress to prevent the longitudinal sides of the deck from bowing out when a person sits on the longitudinal sides of the mattress.

Accordingly, an object of the invention is to provide an air mattress which may be repeatedly assembled and disassembled in a correct manner.

Another object of the invention is to provide a breakdown air mattress having component parts wherein foam deck sections may be joined together only in a prescribed manner within a mattress cover eliminating possible error in the positioning of the deck sections within the mattress cover.

Another object of the invention is to provide a deck constructed of foam or other resilient material which surrounds the perimeter of one or more air mattresses in an air mattress assembly wherein the deck consists of a plurality of individual foam deck sections having ends which are provided with unique joints so that they may be fitted together in a prescribed manner for reliable assembly and disassembly.

SUMMARY OF THE INVENTION

The above objectives are accomplished according to the invention by providing an air mattress which may include a pair of individual air mattresses arranged side-by-side having a longitudinal joint defined by adjoining edges of the mattresses. A deck of resilient foam material surrounds the perimeter of the air mattresses when arranged side-by-side. The air mattresses and deck may be secured by a cover. The deck includes a first side wall carried near a first outer wall of the air mattresses and a second side wall carried near a second outer wall of the air mattresses generally parallel to the first outer wall. A front wall is carried near a third outer wall of the air mattresses and a back wall is carried near a fourth outer wall of the air mattresses. A first joint joins the first deck sections to each other and the second deck sections to each other to form the first and second side walls. The first joint includes first male and female parts which fit together in an interlocking manner. A second joint joins the front deck sections and the back deck sections together to form the respective front and back walls. The second joint means including second male and female parts which fit together in an interlocking manner. A third joint joins the ends of the first side wall to the front and back walls and joins the ends of the second side wall to the front and back walls. The third joint includes third male and female parts which interfit. The first, second, and third inter fitting parts have dissimilar contours so the various deck sections may fit together only in a prescribed manner. A web extends between front and back walls of the deck. The web laterally spans the longitudinal joint between the air mattresses on both sides thereof to effectively isolate the sight and feel of the longitudinal joint underneath the cover.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 1 is a perspective view illustrating an air mattress in an assembled condition with parts partially removed;

FIG. 2 is a top plan view with parts separated of a resilient deck for an air mattress constructed in accordance with the invention;

DESCRIPTION OF A PREFERRED EMBODIMENT

Figure 3:
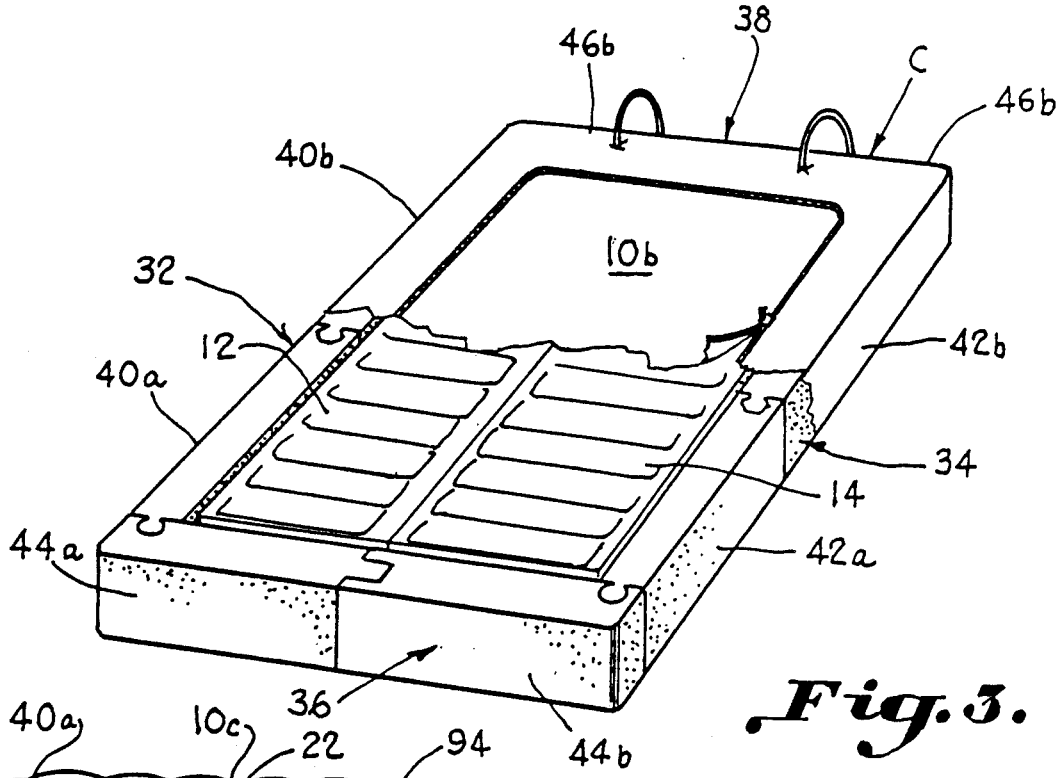
FIG. 3 is a perspective view of a single air mattress and perimetal foam deck according to the invention.

Referring now in more detail to the drawings, an air mattress, designated generally as A, includes an air mattress means B surrounded by a foam perimetal deck C both of which are enclosed in a mattress cover 10. As can best be seen in FIG. 1, air mattress means B includes dual inflatable air mattresses 12 and 14 disposed side-by-side. This arrangement is particularly suitable for queen size and larger mattresses. Air mattresses 14 and 12 may be variably and independently adjusted in their inflation to provide a firmer or softer mattress. This may be accomplished in a conventional sense by an air pump 16 and individual controls 18 and 20 which control respective mattresses 12 and 14 in a conventional manner such as disclosed in U.S. Pat. No. 4,644,597. Dual air mattresses 12 and 14 define a longitudinal joint 22 between adjacent edges. Each air mattress includes a flexible top surface 24 and bottom surface 26 between which a flexible web 28 extends around the four sides of each mattress. A single mattress (not shown) may also be used in a suitable mattress cover along with foam perimetal deck C which may be suitably sized for either a twin size or double size mattress which consists of only a single inflatable air mattress.

As can best be seen in FIG. 2, perimetal deck C may be constructed from any suitable high density polyurethane foam or other resilient material. Since the individual air mattresses tend to be unstable at their edges, the foam deck, which is flush with the top surface of the inflatable air mattresses provides support at the sides of the air mattress. With the air mattress and foam deck fitted inside cover 10, an integral mattress structure is provided which is very comparable to the conventional innerspring mattress in appearance, lay, and feel. Cover 10 may be provided with a zippered opening 10*a* so that the air mattresses and foam deck may be conveniently inserted. As can best be seen in FIG. 3, in practice, cover 10 is laid on a flat surface with quilted top side 10*c* down. Zippered opening 10*a* is on the bottom of the mattress facing up. The zippered opening is unzippered and the foam deck is installed inside the cover. A zippered closure flap 10*b*, having a zipper on three sides and affixed to cover 10 at the remaining side, is folded back for access to the inside of the cover. Next, the air mattress means, either dual or singular is laid inside the perimeter of deck C. Next, the zippered opening may be closed and the air mattress inflated. Thereafter, the air mattress may be turned over with the top side up. The top side may be provided with the conventional quilted appearance. It can be seen that installing the foam deck inside the mattress cover one section at a time can be a relatively tedious task.

As can best be seen in FIG. 2, perimetal deck C includes a first side wall designated generally as 32, and a second side wall designated generally as 34 parallel to side wall 32. A front wall designated generally as 36 extends between a first end 32*a* of first side wall 32 and a first end 34*a* of second side wall 34. A back wall designated generally as 38 extends between a second end 32*b* of first side wall 32 and a second end 34*b* of side wall 34. Walls 32, 38, 34, and 36 are generally mutually orthogonal to each other. First side wall 32 includes a plurality of first deck sections 40*a* and 40*b* joined end-to-end. Second side wall 34 includes a plurality of second deck sections 42*a* and 42*b*. Front wall 36 includes a plurality of front deck sections 44*a* and 44*b*. Back wall 38 includes a plurality of back deck sections 46*a* and 46*b*.

A first joint means, designated generally as D, joins together first deck sections 40*a* and 40*b* in an interlocking manner and joins second deck sections 42*a* and 42*b* together in an interlocking manner. Second joint means, designated generally as E, joins together front deck sections 44*a* and 44*b*, and joins back deck sections 46*a* and 46*b* in an interlocking manner. A third joint means, designated generally as F, joins together first side wall end 32*a* to front deck section 44*a* and joins second end 32*b* to back deck section 46*a*. Likewise, joint means F joins first end 34*a* of the second side wall to front deck section 42*a* and second end 34*b* to back deck section 46*b*.

Joint means D includes a first joint 50 and a second joint 52 each of which includes an interfitting female part 54 and a cooperating and correspondingly shaped male part 56 which interfit in an interlocking manner. Joint means E includes a third joint 60 and a fourth joint 64 each of which includes a female part 66 and a cooperating contoured male part 68 which interfit. Joint means F includes a fifth joint 70, a sixth joint 72, a seventh joint 74, and an eighth joint 76. Each joint of joint means F includes a female part 80 and a corresponding male part 82 which interlocks therewith.

Parts 54 and 56 of joint means D consist of a hexagonal shape having five planar surfaces which interfit. Parts 80 and 82 of joint means F have a rounded contour providing curved surfaces which mate together in an interfitting manner. Parts 66 and 68 of joint means E includes surfaces intersecting one another at 90 degrees in an interfitting manner. As can best be seen in FIG. 2, it is noted that the deck sections can be fitted together only in a prescribed manner. For example, in 32*b* of first side wall 32 must fit into either a front or back wall of the foam deck, and not the mid joint D. Mid joint D can only be comprised of the ends of first deck sections 40*a*, 40*b* and the ends of second deck sections 42*a*, 42*b*. The front deck sections 44*a*, 44*b* and back deck sections 46*a*, 46*b* can only be joined together and not to the mid joints of side wall deck sections.

Figure 4:
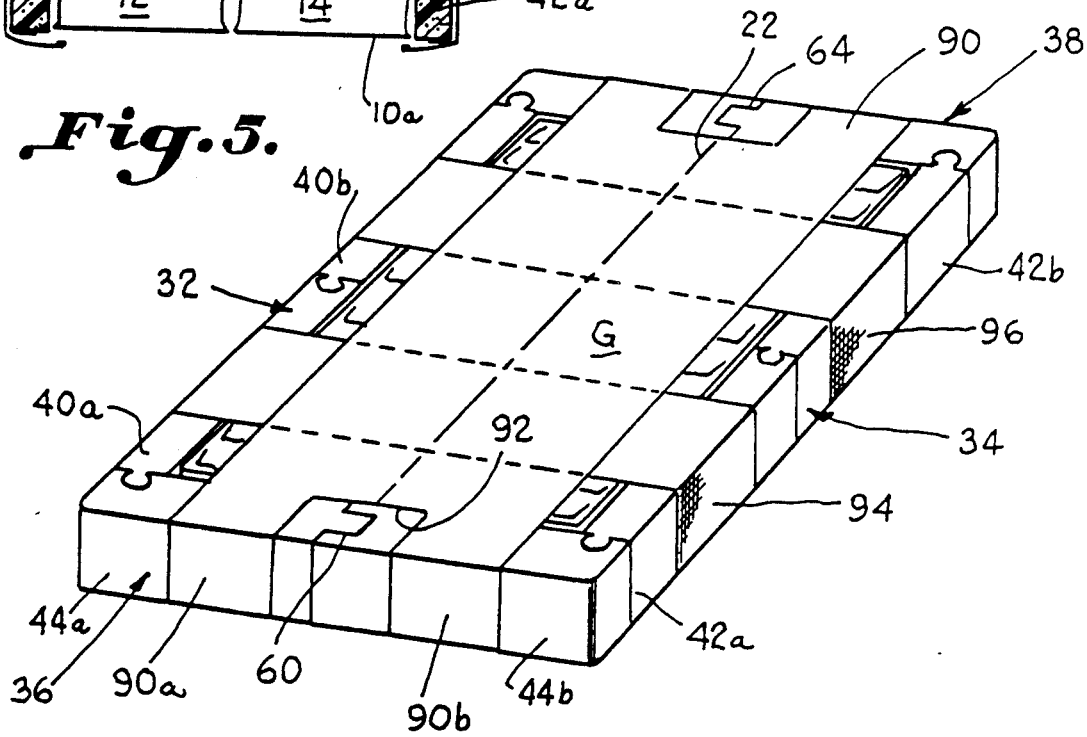
FIG. 4 is a perspective view of a dual air mattress kit and foam perimetal deck according to the invention.

As can best be seen in FIG. 4, a first horizontal web means, designated generally as G, is carried by perimetal deck C and bridges the longitudinal joint 22 formed between dual mattresses 12 and 14. This reduces the appearance and feel of the joint. Preferably, web G is carried by the deck sections of front wall 36 and back wall 38 of deck C. Web means G is illustrated in the form of a single sheet 90 of suitable material having a cutout section 92 which bisects joints 60 and 64 to allow for the joint between the front and back deck sections. Further, there is a first transverse web 94 carried between first and second deck sections 40*a* and 42*a* transverse to web 90 across air mattresses 12 and 14. A second transverse web 96 is carried by first and second deck sections 40*b* and 42*b* across the air mattresses and web 90. While web 90 isolates longitudinal joint 22, all the webs provide the additional function of preventing the deck walls from bowing out when the mattress is in use. While webs 94 and 96 may be one piece, it has been found advantageous to provide this construction in two pieces, particularly for purposes of installation inside mattress cover 10.

Figure 5:
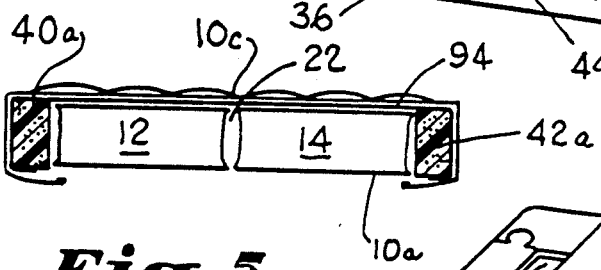
FIG. 5 is a sectional view taken along line 5—5 of FIG. 1.

The ends of the web may be attached to the foam blocks in any suitable manner such as using adhesive, etc. As can best be seen in FIG. 5, the ends of transverse web 94 are attached to the underside surfaces of side wall sections 40a and 42a. Front deck sections 44a, 44b and back deck sections 46a, 46b are interconnected by legs 90a and 90b of web 90, as can best be seen in FIG. 4. The underside of the web legs are attached to blocks 44a and 44b as are the remaining transverse webs 94 and 96. Since webs 90, 94, and 96 must face the bottom side of the top 10c of cover 10, it becomes even more critical that the joints be formed correctly when inserting the foam deck sections inside the cover 10. As previously explained, when installing the deck section, the match cover is turned upside down, as in FIG. 3. If back deck sections, facing the head of the bed, are placed in first, then back wall 36 may be inserted with web 90 unrolled and facing downward. Next, since side wall deck sections 40b, 42b are joined together by web 96, these sections are inserted next into mating joints 72 and 74. The remaining side wall deck sections 40a, 42a can only be inserted in one manner to mate joints 50 and 52. Likewise, the final joints can only be made in one way at 70 and 76. The deck sections of side walls 32 and 34 cannot be put in reverse direction or the webs would be facing the wrong side. Even if deck sections 42a and 40a are reversed, this will be okay as long as web 94 is against the bottom side of top cover 10c facing down. In that case, deck sections 40b, 42b may be placed at the opposite end but reversed in the side walls. It is preferred that the joint means D, E, and F are different from each other, respectively. While it may be possible that joint means D and joint means F are alike, it is preferable that all three joint means be different. Considerable aggravation is encountered even if one deck section is placed in the mattress cover in an improper position in removing the deck sections, particularly considering that the webs are attached to the deck sections and placement is being carried out within the cover with limited access.

Thus, it can be seen in accordance with the present invention that a construction can be had for a breakdown deck for an air mattress assembly in which the deck sections may only be assembly in a prescribed manner. Even one of little mechanical skill may easily put the deck sections together in correct positions so that the air mattress may be assembled simply and reliably. Conceivably, each joint section could be different, however, that would require significantly more attendance to machine operations and cutting of the foam block material. In addition, some interchangeability is desired, for example, the deck sections of front and back walls 36 and 38.

While a preferred embodiment of the invention has been described using specific terms, such description is for illustrative purposes only, and it is to be understood that changes and variations may be made without departing from the spirit or scope of the following claims.

What is claimed is:

1. A breakdown air mattress assembly which includes air mattress means having a flexible top surface, a flexible bottom surface, and flexible side webs extending between said top surface and bottom surface around the perimeter of said mattress means, a perimetal deck constructed from a resilient material being generally flush with said mattress means surrounding an outer perimeter wall of said mattress means, and a cover in which said mattress means and perimetal deck are enclosed, wherein said perimetal deck comprises:

a first side wall carried near a first outer wall of said mattress means;

a second side wall generally flush with said mattress means carried near a second outer wall of said mattress means;

a front wall generally flush with said mattress means carried near a third outer wall of said mattress means;

a back wall generally flush with said mattress means carried near a fourth outer wall of said mattress means;

said first side wall including a plurality of deck sections and a first joint by which said first plurality of deck sections are joined to each other;

said second side wall including a second plurality of deck sections and a second joint connecting said deck sections together;

said back wall including a plurality of back deck sections and a third joint for connecting said back deck sections together;

said front wall including a plurality of front deck sections and a fourth joint for connecting said front deck sections together;

a fifth joint for joining one of said first deck sections to one of said front deck sections;

a sixth joint for joining another of said first deck sections to one of said back deck sections;

a seventh joint for joining one of said second deck sections to another of said back deck sections;

an eighth joint for joining another of said second deck sections to another of said back deck sections; and said first and second joints including interfitting parts carried by respective deck sections having a first contoured shape which is different from a second contoured shape of said interfitting parts of said third and fourth joints so that said first and second deck sections and said front and back deck sections may be respectfully interfitted in a prescribed manner.

2. The apparatus of claim 1 wherein said fifth, sixth, seventh, and eighth joint means include interfitting parts carried by respective ones of said deck sections having a third contoured shape which is different from said first and second contoured shape of said first and second interfitting parts.

3. The apparatus of claim 2 including a first horizontal web carried by said front and back walls which extends over said mattress means.

4. The apparatus of claim 3 including second horizontal web extending between said first and second deck sections transverse to said first horizontal web.

5. The apparatus of claim 4 wherein said air mattress means includes a pair of individual air mattresses having longitudinal joints defined by adjoining edges of said mattresses, and said first web bridges said longitudinal joint generally the entire length of said mattress means to effectively isolate said joint.

6. In an air mattress assembly, the combination comprising:

a pair of air mattresses adapted to be arranged side-by-side defining a longitudinal joint between said air mattresses;

a deck of resilient foam material for surrounding the perimeter of said air mattresses when arranged side-by-side;

a cover in which said air mattresses and deck may be secured;

said deck including a first side wall carried near a first outer wall of said air mattresses, a second side wall carried near a second outer wall of said air mattresses generally parallel to said first outer wall;

a front wall carried near a third outer wall of said air mattresses, and a back wall carried near a fourth outer wall of said air mattresses;

joint means for joining said first and second side walls, and said front and back walls together to form a deck generally flush with said air mattresses around said outer perimeter of said air mattresses;

web means integrally attached to front and back walls of said perimetal deck laterally bridging said longitudinal joint between said air mattresses along generally the entire length of said air mattresses to effectively isolate the sight and feel of said longitudinal joint underneath said cover, and to reduce the tendency of said opposing walls to spread apart;

said first side wall including a plurality of first deck sections; said second wall including a plurality of second deck sections; said back wall including a plurality of back wall sections; and said front wall including a plurality of front deck sections; and said web means being individually attached to each of said plurality of said front and back deck sections so that said deck sections may be disjointed for breakdown of said deck.

7. The apparatus of claim 6 wherein said first side wall includes a plurality of first deck sections;

said second side wall includes a plurality of second deck sections;

said back wall includes a plurality of back wall sections; and said front wall includes a plurality of front deck sections.

8. The apparatus of claim 6 wherein said web includes a gap at opposing ends of said web which bridges said joint between adjoining ones of said front and back deck sections.

9. The apparatus of claim 7 wherein said web means is attached to each of said plurality of said front and back deck sections.

10. The apparatus of claim 9 wherein said web means consists of a single sheet which extends between said front and back side walls.

11. In an air mattress assembly of the type which includes inflatable air mattress means having an outer perimeter wall; a perimetal deck of resilient foam material carried around the outer wall of said air mattress means; and a cover having an opening through which said air mattress means and perimetal deck may be inserted; said perimetal deck including a first side wall having a plurality of first deck sections joined together; a second side wall which includes a plurality of second deck sections joined together generally parallel to said first side wall; a back wall having a plurality of back deck sections extending between said first and second side walls; and a front wall having a plurality of front deck sections extending between said first and second side walls; wherein the improvement comprises:

first joint means for joining said first deck sections to each other and for joining said second deck sections to each other to form said first and second side walls;

second joint means for joining said front deck sections and for joining said back deck sections together to form said respective front and back walls;

third joint means for joining ends of said first side wall to said front and back walls and for joining said ends of said second side wall to said front and back walls;

said first joint means including first male and female parts which fit together in an interlocking manner;

said second joint means including second male and female parts which fit together in an interlocking manner; and said third joint means includes third male and female parts which fit together in an interlocking manner.

12. The apparatus of claim 11 wherein said first and second joint means includes first and second female parts having a different contoured shape so that said first and second deck sections may be joined only in a prescribed manner.

13. The apparatus of claim 12 wherein said third joint means includes third male and female parts having a contoured shape which is different from the shape of said first and second male and female parts so that said first deck sections, second deck sections, back deck sections, and front deck sections may be joined together only in a prescribed manner.

14. The apparatus of claim 11 wherein said first and third joint means having interfitting male and female parts with different contoured shapes.

15. The apparatus of claim 11 wherein said second and third joint means have interfitting male and female parts with different contoured shapes.

16. The apparatus of claim 11 including a first horizontal web carried by said front and back walls which extends over said mattress means; said air mattress means includes a pair of individual air mattresses having longitudinal joints defined by adjoining edges of said mattresses, and said first web bridges said longitudinal joint generally the entire length of said mattress means to effectively isolate said joint.

* * * * *